US005702879A

United States Patent [19]

Barcock

[11] Patent Number: 5,702,879

[45] Date of Patent: Dec. 30, 1997

[54] PROCESS OF PREPARING MONODISPERSED TABULAR SILVER HALIDE EMULSION

[75] Inventor: Richard A. Barcock, Bishop's Stortford, United Kingdom

[73] Assignee: Minnesota Mining and Manufacturing Company, St. Paul, Minn.

[21] Appl. No.: 606,715

[22] Filed: Feb. 27, 1996

[30] Foreign Application Priority Data

Mar. 29, 1995 [EP] European Pat. Off. ..... 95104629

[51] Int. Cl.[6] ..... G03C 1/015; G03C 1/043; G03C 1/035

[52] U.S. Cl. ..... 430/569; 430/627

[58] Field of Search ..... 430/569, 627

[56] References Cited

U.S. PATENT DOCUMENTS

| | | | |
|---|---|---|---|
| 4,184,877 | 1/1980 | Maternaghan | 430/567 |
| 4,301,241 | 11/1981 | Saito | 430/569 |
| 4,386,156 | 5/1983 | Mignot | 430/567 |
| 4,425,426 | 1/1984 | Abbott et al. | 430/502 |
| 4,722,886 | 2/1988 | Nottorf | 430/569 |
| 4,797,354 | 1/1989 | Saitou et al. | 430/567 |
| 4,798,775 | 1/1989 | Yagi et al. | 430/569 |
| 4,801,522 | 1/1989 | Ellis | 430/569 |
| 4,945,037 | 7/1990 | Saitou | 430/567 |
| 4,977,074 | 12/1990 | Saitou et al. | 430/567 |
| 5,013,641 | 5/1991 | Buntainer et al. | 430/569 |
| 5,028,521 | 7/1991 | Grzeskowiak | 430/569 |
| 5,215,879 | 6/1993 | Suzuki et al. | 430/569 |
| 5,254,453 | 10/1993 | Chang | 430/569 |
| 5,595,864 | 1/1997 | Van Den Zegel et al. | 430/569 |
| 5,616,455 | 4/1997 | Murphy | 430/569 |

FOREIGN PATENT DOCUMENTS

| | | | |
|---|---|---|---|
| 0 503 700 A1 | 9/1992 | European Pat. Off. | G03C 1/07 |
| 0 513 722 A1 | 11/1992 | European Pat. Off. | G03C 1/07 |
| 0 513 723 A1 | 11/1992 | European Pat. Off. | G03C 1/07 |
| 0 513 724 A1 | 11/1992 | European Pat. Off. | G03C 1/07 |
| 0 513 725 A1 | 11/1992 | European Pat. Off. | G03C 1/07 |
| 0 569 075 A1 | 11/1993 | European Pat. Off. | G03C 1/005 |
| 0 577 886 A1 | 1/1994 | European Pat. Off. | G03C 1/005 |
| 0 588 338 A2 | 3/1994 | European Pat. Off. | G03C 1/005 |
| 1-213637 | 8/1989 | Japan | G03C 1/02 |
| 7-72574 | 3/1995 | Japan | G03C 1/07 |
| WO92/07295 | 4/1992 | WIPO | G03C 1/015 |

*Primary Examiner*—Mark F. Huff
*Attorney, Agent, or Firm*—Mark A. Litman; Walter N. Kirn

[57] ABSTRACT

The present invention relates to a process for preparing monodispersed tabular silver halide grain emulsions, said process comprising the following steps:

(a) forming a population of silver halide nuclei in a dispersing medium having a pH lower than 3 and a pBr in the range of from 1 to 2, (b) ripening said population of silver halide nuclei in presence of a silver halide solvent, (c) performing a first growing of said silver halide nuclei at a pBr value in the range of from 1 to 2, and (d) performing a second growing of said silver halide nuclei at a value in the range of from 2 to 2.7.

According to a preferred embodiment of the present invention a polyalkylene oxide-polyalkylsiloxane copolymer is present during at least one of the above mentioned steps (a) to (d). The process of the present invention enable the growth of monodispersed tabular silver halide grain emulsions having a reduced amount of non-conforming grains and a lower coefficient of variation (COV).

17 Claims, No Drawings

PROCESS OF PREPARING MONODISPERSED TABULAR SILVER HALIDE EMULSION

FIELD OF THE INVENTION

The present invention relates to a process for preparing monodispersed tabular silver halide emulsion useful in light-sensitive photographic materials.

BACKGROUND OF THE INVENTION

Tabular silver halide grains, their preparation and use in photographic emulsions, are widely known. Tabular silver halide grains are crystals possessing two major faces that are substantially parallel. They have been extensively studied in the literature since photographic emulsions containing these grains appeared to offer some significant advantages over photographic emulsions containing round or globular or cubic grains. Tabular grains usually have polygonal (i.e., triangular or hexagonal) parallel crystal faces, each of which is usually greater than any other crystal face of the grain and are conventionally defined by their aspect ratio (namely AR) which is the ratio of the diameter of the grain to the thickness. Tabular grains offer significant technical and commercial advantages apparent to those skilled in the art. The most important advantages of tabular grains can be summarized as follows:

1. Tabular grains have a high surface to volume ratio so that a large amount of sensitizing dye can be adsorbed on the surface, and a high development rate and covering power can be obtained.

2. Tabular grains tend to lie parallel to the surface of the support base when emulsions containing them are coated and dried so that it is possible to reduce the thickness of the coated layer and accordingly to increase sharpness.

3. When a sensitizing dye is added to tabular grains, the extinction coefficient of the dye is greater than the extinction coefficient for the indirect transition of the silver halide so that in X-ray materials it is possible to obtain a relevant reduction in cross-over, thereby preventing any worsening of quality.

4. Tabular grains are usually very thin and so the amount of radiation absorbed per grain (proportional to the thickness) is low and there is low fogging due to natural radiation on aging.

5. Tabular grains show low light scattering and the images obtained from them have a high resolution.

In spite of all these advantages, tabular grain emulsions tend toward more dispersed grain populations than can be achieved in the preparation of conventional silver halide grains. This has been a concern since reducing grain dispersion or variation in grain size within an emulsion is a basic approach to increasing the imaging consistency of the emulsion. Grain dispersion concern relates to (1) the presence of non-conforming grain shapes, such as, for example, octahedral, cubic, or rod shapes and (2) to the variance of the grain size distribution. Non-conforming grains can interact differently with light and exhibit some undesirable properties. For example, faces of non-tabular grains are randomly oriented with respect to the support base, octahedral grains exhibit lower covering power and greater thickness, and rod grains can self develop in the absence of light, thereby increasing fog.

On the other hand, even a population of grains having a common shape can have a high dispersion in terms of grain size distribution. A common method for quantifying grain size distribution is to extract a sample of individual grains, calculate the corresponding diameter for each grain ($D_{1\rightarrow n}$, wherein n is the number of extracted grains), calculate the average diameter ($Dm=\Sigma_{1\rightarrow n}D/n$), calculate the standard deviation of the grain population diameters (S), divide the standard deviation (S) by the average diameter (Dm) and multiply by 100, thereby obtaining the coefficient of variation (COV) of the grain population as a percentage.

It is known in the art that emulsions having a low COV (e.g., lower than 30%) can be optimally sensitized as a result of their similar surface areas, have low light scattering and therefore a high image sharpness as a result of the reduction of the finer grain population, have a low granularity as a result of the reduction of the larger grain population, and have a higher contrast.

Accordingly, various solutions have been proposed in the art to reduce the COV of tabular grain emulsions. Monodispersed tabular grain emulsions and methods to prepare them are disclosed for example in U.S. Pat. No. 4,150,994, U.S. Pat. No. 4,184,877, U.S. Pat. No. 4,184,878, U.S. Pat. No. 4,301,241, U.S. Pat. No. 4,386,156, U.S. Pat. No. 4,400,463, U.S. Pat. No. 4,425,426, U.S. Pat. No. 4,797,354, U.S. Pat. No. 4,977,0747, U.S. Pat. No. 4,945,037, U.S. Pat. No. 5,215,879, U.S. Pat. No. 4,798,775, U.S. Pat. No. 4,722,886, U.S. Pat. No. 4,801,522, U.S. Pat. No. 5,013,641, U.S. Pat. No. 5,254,453, EP 503,700, EP 569,075, EP 577,886, EP 588,338, EP 600,753. These patents and patent applications attempt to obtain monodispersed tabular grains by controlling various parameters during nucleation and ripening of the silver halide emulsion. The most important nucleation conditions to be kept under control for obtaining monodispersed tabular grain emulsions are temperature, gelatin concentration, addition rates of silver salt solution, addition rates of alkali halide solution, stirring rate, iodide content in the alkali halide solution, amount of silver halide solvent, pH of the dispersing medium, concentration of bromide ions in the reaction vessel, molecular weight of dispersing medium, iodide content in the vessel at the start, and the like. Similarly, the most important ripening conditions are temperature, dispersing medium concentration, silver halide solvent concentration, pBr, and addition rates of silver salt solution.

Maternaghan in U.S. Pat. No. 4,150,994, U.S. Pat. No. 4,184,877, and U.S. Pat. No. 4,184,878 describes the formation of thick monodispersed tabular grain emulsion from seed crystals having at least 90% mol of iodide.

Saito in U.S. Pat. No. 4,301,241 describes a process for forming a silver halide emulsion containing multiple twin crystal grains and a narrow grain size distribution. The examples report multiple twin crystal grain silver bromoiodide emulsions having an average grain size from 0.86 to 1.023 μm and a coefficient of variation of from 11.6% to 13.6%.

Mignot in U.S. Pat. No. 4,386,156 describes silver bromide tabular grain emulsions having an aspect ratio of at least 8.5:1 and a COV of less than 30. The tabular grains described by Mignot are bounded by (100) crystal faces and are square or rectangular.

Abbot et al. in U.S. Pat. No. 4,425,426 disclose a radiographic element comprising tabular grain emulsion in which grains having thickness lower than 0.2 μm, and average aspect ratio from 5:1 to 8:1, account for at least 50% of the total projected area. During precipitation of silver halide grains the rate of introduction of silver and halide salts is maintained below the threshold level at which the formation of new grain nuclei is favored in order to obtain relatively monodispersed thin tabular grains with COV lower than 30%.

Saitou et al. in U.S. Pat. No. 4,797,354 disclose a silver halide emulsion comprising hexagonal tabular grains with an "adjacent edge ratio" of from 2/1 to 1/1 accounting for 70% to 100% of the projected area of all the grains, and further that said hexagonal tabular grains are monodisperse and have an average aspect ratio from 2.5:1 to 20:1. The term "adjacent edge ratio" is referred to as the ratio of the longest edge length to the shortest edge length of each hexagonal tabular grain. Accordingly, the definition of "adjacent edge ratio" is a measure of the hexagon regularity.

Saitou et al. U.S. Pat. No. 4,977,074 disclose and claim a silver halide emulsion comprising substantially circular tabular grains with a "linear ratio" equal to or lower than 2/5 accounting for from 70% to 100% of the projected area of all the grains, and further that said circular tabular grains are monodispersed. The term "linear ratio" is defined as the ratio of the total length of the linear portion in the substantially circular tabular grain divided by the total length of the extrapolated hexagonal tabular grain. The lower the linear ratio value, the more circular the grain.

U.S. Pat. No. 4,945,037 discloses a process to produce a tabular silver halide grain emulsion in which at least 60% of the total projected area is covered by tabular grains having a core portion and an outer portion, the iodide content of the core portion being from 7 mol% to the solid solution limit. The process is characterized by specific nucleating condition, that is, a gelatin concentration of from 0.1 to 20% by weight, an addition rate of silver and halide salts of from $6\times10^{-4}$ to $2.9\times10^{-1}$ mol/minute per liter, and a pBr value of from 1.0 to 2.5.

U.S. Pat. No. 4,798,775 discloses a process to obtain monodispersed tabular grains comprising the steps of forming silver halide nuclei with a silver iodide content of from 0 to 5% in the mother liquor, by maintaining the pBr in the reaction vessel between 2.0 and −0.7 for at least the initial half of the nucleation time, ripening the nuclei formed in the nucleation step by maintaining the concentration of silver halide solvent from $10^{-4}$ to 5 moles per liter of mother liquor, and growing the seed grains by addition of silver and halide soluble salts or by addition of fine silver halide grains.

U.S. Pat. No. 4,801,522 discloses a process to form tabular silver halide grains having a thickness of from 0.05 to 0.5 μm, average grain volume of from 0.05 to 1.0 $\mu m^3$ and a mean aspect ratio higher than 2:1 comprising the steps of adding silver nitrate to a reaction vessel comprising a bromide ion concentration of from 0.08 to 0.25N (pBr=1, 1–0,6), adding ammonia solution to achieve 0.002 to 0.2N after at least 2% of the total silver has been added to the vessel, and adding silver and halide (Br or BrI) salts by balanced double jet.

U.S. Pat. No. 4,722,886 describes a process to form a monodispersed tabular silver halide grain emulsion comprising the steps of adding silver nitrate to a reaction vessel comprising a bromide ion concentration of from 0.08 to 0.25N to form silver halide nuclei, adding a basic silver halide solvent (e.g., ammonia solution) to achieve 0.02 to 0.2N after at least 2% by weight of the total silver has been added to the vessel, stopping silver nitrate addition for a time period of from 0.5 to 60 minutes at a Br ion concentration of from 0.005 to 0.05N, neutralizing at least part of the present solvent, and growing the formed silver halide grains by adding silver and halide (Br or BrI) soluble salts by balanced double jet.

U.S. Pat. No. 5,013,641 describes a process of forming monodispersed silver halide emulsions comprising (a) combining silver nitrate and sodium bromide in gelatin solution, (b) adding NaOH to adjust the pH to greater than 9, (c) allowing digestion of the nucleated particles, (d) adjusting the pH to below 7 by acid addition, and (e) adding silver nitrate and sodium halide to grow the nucleated particles.

U.S. Pat. No. 5,254,453 discloses a process for forming monodispersed silver bromide or bromoiodide grains with COV lower than 25%, thickness of from 0.05 to 0.5 μm, mean aspect ratio higher than 2, and diameter of from 0.2 to 3 μm comprising the following steps: (a) digesting the nucleated particles in a basic silver halide solvent at a concentration of from 0.0015 to 0.015N and (b) neutralizing said basic solvent after digestion and before growing.

EP 503,700 discloses a process of forming monodispersed silver bromide or bromoiodide tabular emulsions with a COV lower than or equal to 15% characterized by the addition of an aminoazaindene at any stage of the preparation, but before 50% of the total silver halide is precipitated.

EP 569,075 discloses a process of forming monodispersed silver bromide or bromoiodide tabular emulsions with average aspect ratio higher than 2, an average thickness of from 0.15 and 0.30 μm, and a COV of from 0.15 to 0.45 wherein the process is characterized by (a) providing a gelatin/bromide solution at a pBr of from 1.0 to 2.0, (b) nucleating by consuming less than 10% of the total silver nitrate used, (c) a first double jet growth (consuming at least 10% of the total silver nitrate used) at a pBr value of from 1.0 and 2.5, and (d) a second double jet growth (consuming at least 40% of the total silver nitrate used) at a pBr value higher than 2.7

EP 577,886 describes a process of forming monodispersed silver bromide or bromoiodide tabular emulsions with average-aspect ratio of from 2 to 8, and a COV lower than 30. The process comprises the following steps: (a) performing a nucleation step by balanced double jet by precipitating at most 5% of the total silver halide, (b) ripening the formed nuclei, (c) performing at least one growing step by balanced double jet at pBr lower than 2, (d) ultrafiltrating the reaction mixture during the precipitation steps with an ultrafiltration flux equal to or greater than the sum of the flow rates of the silver and halide ion solutions.

Grzeskowiak, in U.S. Pat. No. 5,028,521, discloses a process for preparing monodispersed tabular silver halide grain emulsions having an aspect ratio from 3:1 to 12:1 consisting in (a) preparing a bromide/gelatin mixture at pBr of from 0.7 to 1.0 (b) adding silver nitrate and further halide to maintain excess of bromide (c) adding ammonia to achieve at least 0.05N after at least 20% by weight of the total silver is added, (d) adding further silver nitrate and halide by balanced double jet, by maintaining an ammonia concentration of at least 0.03N.

EP 588,338 describes a process characterized by specific nucleating condition, that comprises (a) adding from 0.30 to 9.0% by weight of the total amount of soluble silver salt to a vessel containing 0.08 to 0.25M aqueous soluble halide salt (b) adding a solution of ammoniacal base when 0.30 to 9% by weight of the total amount of soluble silver salt has been added, (c) adding soluble silver salt to obtain growth pBr of from 1.3 to 2.3, and (d) adding soluble silver and halide salts to grow tabular grains Other recent patents and patent applications attempt to obtain monodispersed silver halide tabular emulsion by adding a specific polymeric surfactant during nucleation and/or ripening.

U.S. Pat. No. 5,215,879 describes a process to obtain monodispersed silver halide emulsions in which a polymer having the following formula is added during the ripening step.

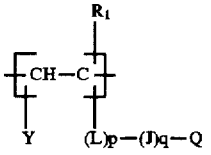

wherein Y is H or carboxyl group; $R_1$ is H, a halogen atom, an alkyl group or $CH_2COOM$, where M is H or an alkali metal atom; L is —CONH—, —NHCO—, —COO—, OCO—, —CO—, or —O—; J is an alkylene group, an arylene group, or $(CH_2CH_2O)m(CH_2)n$, where m is an integer from 0 to 40 and n is an integer from 0 to 4; and Q is H, alkyl group, a N-containing heterocyclic group, a quaternary ammonium group, a dialkylamino group, OM, $—NH_2$, $—SO_3M$, $—O—PO_3M_2$ and —CO—R.

EP 513,722, EP 513,723, EP 513,724, and EP 513,725 describe a process in which monodispersed tabular emulsions are obtained by adding, during nucleation, polymers having the following general formulas (1) to (4), respectively.

(1) LAO-HAO-LAO (2) HAO-LAO-HAO (3) HAO-LAO-L-LAO-HAO (4) LAO-HAO-L-HAO-LAO wherein LAO is a lipophilic alkylene oxide block unit, HAO is a hydrophilic alkylene oxide block unit, and L is a trivalent or tetravalent organic group comprising nitrogen.

SUMMARY OF THE INVENTION

The present invention relates to a process for preparing monodispersed tabular silver halide grain emulsions, said process comprising the following steps:

(a) forming a population of silver halide nuclei in a dispersing medium having a pH lower than 3 and a pBr in the range of from 1 to 2, (b) ripening said population of silver halide nuclei in presence of a silver halide solvent, (c) performing a first growing of said silver halide nuclei at a pBr value in the range of from 1 to 2, and (d) performing a second growing of said silver halide nuclei at a value in the range of from 2 to 2.7.

According to a preferred embodiment of the present invention a polyalkylene oxide-polyalkylsiloxane copolymer is present during at least one of the above mentioned steps (a) to (d). The process of the present invention enables the growth of monodispersed tabular silver halide grain emulsions having a reduced amount of non-conforming grains and a lower coefficient of variation (COV).

DETAILED DESCRIPTION OF THE INVENTION

The present invention relates to a process for preparing monodispersed tabular silver halide grain emulsions, said process comprising the following steps:

(a) forming a population of silver halide nuclei in a dispersing medium having a pH lower than 3 and a pBr in the range of from 1 to 2, (b) ripening said population of silver halide nuclei in presence of a silver halide solvent, (c) performing a first growing of said silver halide nuclei at a pBr value in the range of from 1 to 2, and (d) performing a second growing of said silver halide nuclei at a value in the range of from 2 to 2.7.

GRAIN PREPARATION

Tabular silver halide grains contained in the silver halide emulsions of the present invention have an average diameter:thickness ratio (often referred to in the art as aspect ratio) of at least 2:1, preferably 2:1 to 20:1, more preferably 2:1 to 14:1, and most preferably 2:1 to 8:1. Average diameters of the tabular silver halide grains suitable for use in this invention range from about 0.3 to about 5 μm, preferably 0.5 to 3 μm, more preferably 0.8 to 1.5 μm. The tabular silver halide grains suitable for use in this invention have a thickness of less than 0.4 μm, preferably less than 0.3 μm and more preferably within 0.1 to 0.3 μm.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the method used, the average diameter:thickness ratios obtained do not greatly differ.

The projected area of the tabular silver halide grains obtained with the process of the present invention accounts for at least 50%, preferably at least 80% and more preferably at least 90% of the projected area of all the silver halide grains of the emulsion. The coefficient of variation of the tabular grain emulsion obtained with the process of the present invention is lower than 20%, preferably lower than 15%.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol% silver iodide, preferably from 0.2 to 5 mol% silver iodide, and more preferably from 0.5 to 1.5% mol silver iodide. The halogen composition of individual grains may be homogeneous or heterogeneous.

The preparation process of a silver halide emulsion generally comprises a nucleation step, in which silver halide grain seeds are formed, followed by one or more growing steps, in which the grain seeds achieve their final dimension, and a washing step, in which all soluble salts are removed from the final emulsion. A ripening step is usually present between the nucleation and growing step and/or between the growing and the washing steps.

According to the process of the present invention, an aqueous solution of a dispersing medium is put in a reaction vessel together with a bromide salt aqueous solution. The dispersing medium initially present in the reaction vessel can be chosen among those conventionally employed in the silver halide emulsions. Preferred dispersion media include hydrophilic colloids, such as proteins, protein derivatives, cellulose derivatives (e.g. cellulose esters), gelatin (e.g. acid or alkali treated gelatin), gelatin derivatives (e.g. acetylated gelatin, phthalated gelatin and the like), polysaccharides (e.g. dextran), gum arabic, casein and the like. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like. The bromide salt is typically a water soluble salt of alkaline or alkaline earth metals, such as, for example, sodium bromide, potassium bromide, ammonium bromide, calcium bromide, or magnesium bromide.

The temperature of the reaction vessel content is preferably in the range of from 30° C. to 80° C., more preferably from 40° C. to 70° C. The pH of the starting solution is lower than 3 and preferably ranges from 1.5 to 2.5. The pBr of the starting solution ranges from 1 to 2, preferably from 1.2 to 1.7.

During the nucleation step (a), a bromide salt and a silver nitrate aqueous solution are added by double jet method to the reaction vessel at a constant flow rate ranging from 30 to 120 ml/min, preferably from 45 to 90 ml/min, by maintaining the temperature constant. During the nucleation step, the amount of silver nitrate added is from 0.5 to 5% by weight of the total silver nitrate employed. According to the present invention, the term "total silver nitrate" means the amount of silver nitrate employed during the overall emulsion making process, that is, from the nucleation step to the final growing step.

At the end of the nucleation step, the addition of bromide salt and silver nitrate is stopped and the obtained silver halide seed grains are subjected to the ripening step (b). The silver halide seeds are allowed to ripen at a temperature of from 30° to 80° C., preferably from 50° to 80° C., for a period of time ranging from 10 to 30 minutes, preferably from 15 to 25 minutes, in the presence of a silver halide solvent. The silver halide solvent, e.g., thiourea, ammonia, thioether, thiosulfate or thiocyanate, can be added at any time before, during or after the nucleation step, just before the starting of the ripening step, or during the ripening step. According to a preferred embodiment the silver halide solvent is added after at least 5 minutes of the ripening step, preferably after at least 10 minutes of the ripening step. The concentration of the silver halide solvent into the reaction vessel can range from 0.002 to 0.2N. According to a preferred embodiment the silver halide solvent is an ammonia aqueous solution.

After that the silver halide seed grains are subjected to a first growth (c) by double jet addition of a silver nitrate aqueous solution and a halide salt aqueous solution at accelerated flow rate, with a linear ramp starting from within 5 to 15 ml/min and rising to within 15 to 40 ml/min, preferably from within 5 to 10 ml/min and rising to within 15 to 30 ml/min. The halide salt aqueous solution added during this step can either comprise bromide ions or bromoiodide ions. Just before the starting of the double jet addition, the pBr is adjusted to a value of from 1 to 2, preferably from 1.2 to 1.8, by single jet addition of a silver nitrate solution, and the pH is adjusted and controlled at a value of from 6 to 8, preferably from 6.5 to 7.5.During this first growth step, the amount of silver nitrate added is from 20 to 30% by weight of the total silver nitrate employed.

At the end of the first growing step, the pBr is adjusted to a value of from 2 to 2.7, preferably from 2.2 to 2.6 by single jet addition of a silver nitrate solution, The second growth (d) is performed by a second double jet addition of silver nitrate and halide salt aqueous solutions at accelerated flow rate, with a linear ramp starting from within 5 to 15 ml/min and rising to within 15 to 40 ml/min, preferably starting from within 5 to 10 ml/min and rising to within 15 to 30 ml/min. The halide salt aqueous solution added during this step can either comprise bromide ions or bromoiodide ions. During this second growth step, the amount of silver nitrate added is from 20 to 30% by weight of the total silver nitrate employed.

At the end of the second growing step, the obtained tabular silver halide grains are further grown to reach the proper size by double jet addition of silver nitrate and halide sail aqueous solutions at accelerated flow rate, with a linear ramp starting from within 5 to 15 ml/min and rising to within 15 to 40 ml/min, preferably from within 5 to 10 ml/min and rising to within 15 to 30 ml/min. The halide salt aqueous solution added during this step can either comprise bromide ions or bromoiodide ions. During this final growing step, the amount of silver nitrate added is from 30 to 50% by weight of the total silver nitrate employed.

If during the growing steps, a soluble iodide salt is added together with the bromide salt, the amount of the iodide present in the final emulsion ranges from 0.01 to 10% mol, preferably from 0.05 to 5% mol based on the total halide.

At the end of the growing steps, the tabular grains can be further ripened for a period of time of from 1 to 20 minutes by addition of a silver halide solvent in an amount of from 0.1 to 30 g per mole of silver halide. Useful ripening agents include silver halide solvents such as, for example, thiourea, ammonia, thioether, thiosulfate or thiocyanate.

At the end of silver halide grain precipitation, water soluble salts are removed from the emulsion by procedures known in the art. Suitable cleaning arrangements are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

In a particularly preferred embodiment, among the known techniques for removing the dispersing medium and soluble salts while retaining silver halide grains in the remaining dispersion, ultrafiltration is a particularly advantageous cleaning arrangement for the practice of this process. Typically, an ultrafiltration unit comprising membranes of inert, non-ionic polymers is used as a cleaning arrangement. Since silver halide grains are large in comparison with the dispersing medium and the soluble salts or ions, silver halide grains are retained by said membranes while the dispersing medium and the soluble salts dissolved therein are removed.

The action mechanism of preferred membranes is described in GB 1,307,331. The membranes used in the ultrafiltration comprise a very thin layer of extremely fine pore texture supported upon a thicker porous structure. Suitable membranes consist of polymers such as polyvinylacetate, polyvinylalcohol, polyvinylformate, polyvinylethers, polyamides, polyimides, polyvinyl chloride and polyvinylidene chloride, aromatic polymers, such as aromatic polyesters, polytetrafluoroethylene, regenerated cellulose, cellulose esters, such as cellulose acetate, or mixed cellulose esters. The membranes in question have anisotropic, semipermeable properties, show considerable mechanical, thermal and chemical stability and are photographically inert. The membranes are preferably permeable to molecules having molecular weights of up to about 300,000 and, more especially, of up to about 50,000.

ADDITION OF POLYALKYLENE OXIDE-POLYALKYLSILOXANE COPOLYMER

According to a preferred embodiment of the present invention a polyalkylene oxide-polyalkylsiloxane copolymer is added at any time within at least one of the above mentioned steps (a) to (d). According to a more preferred embodiment of the present invention, the polyalkylene oxide-polyalkylsiloxane copolymer is added to the reaction vessel just before the start of the nucleation step (a).

The polyalkylene oxide-polysiloxane copolymer of the present invention is a block, graft, or randomly copolymerized polymer having units in the polymer backbone chain(s) that are polyalkylene oxides and polyalkylsiloxane. The polymers must contain at least 10% of each of these types of units on a molar basis of the total polymer composition to be within this class. It is preferred that each of the two moieties comprise from 10 to 90 molar percent of the total polymer, preferably from 20 to 80 molar percent of the total polymer, and there may be additional moieties of up to 30 molar percent copolymerized therewith, as long as the required minimums for each moiety of the basic two moieties are present in the copolymer.

According to a first embodiment the polyalkylene oxide-polyalkylsiloxane copolymer can be represented by the following formula (I):

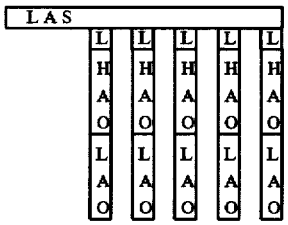

(I)

wherein LAS represents a lipophilic alkylene siloxane block unit, HAO represents a hydrophilic alkylene oxide block unit, LAO represents a terminal lipophilic alkylene oxide block unit, and L is a lipophilic hydrocarbon system.

According to a second embodiment the polyalkylene oxide-polyalkylsiloxane copolymer can be represented by the following formula (II):

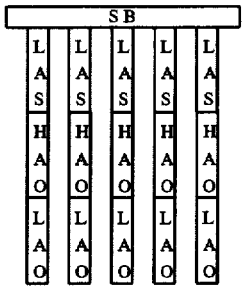

(II)

wherein LAS represents a lipophilic alkylene siloxane block unit, HAO represents a hydrophilic alkylene oxide block unit, LAO represents a terminal lipophilic alkylene oxide block unit, and SB is a silicone backbone.

The polyalkylene oxide-polyalkylsiloxane copolymer according to formula (I) is a linear polyalkylsiloxane having polyalkylene oxide groups attached thereto through a short hydrocarbon chain that can also be represented by the following general formula (III):

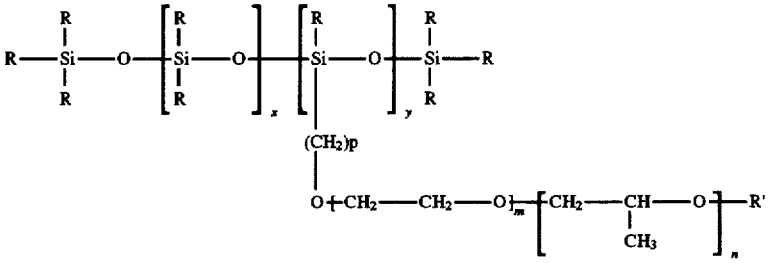

(III)

wherein R is a methyl group, R' can be either hydrogen or a lower alkyl radical of from 1 to 4 carbon atoms, x is an integer from 0 to 100, y is an integer from 1 to 50, m is an integer from 1 to 50, n is an integer from 1 to 50, and p is an integer from 2 to 6.

The polyalkylene oxide-polyalkylsiloxane copolymer according to formula (II) is a branched polyalkylsiloxane in which the polyalkylene oxide block units are joined to a silicone backbone through an alkylsiloxane block unit, and can also be represented by the following general formula (IV):

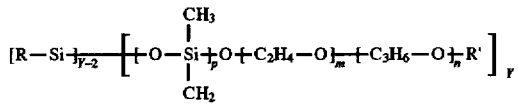

(IV)

wherein R is a methyl group, R' can be either hydrogen or a lower alkyl radical of from 1 to 4 carbon atoms, y is an integer from 3 to 50, m is an integer from 1 to 50, n is an integer from 1 to 50, and p is an integer from 1 to 50.

Typical examples of polyalkylene oxide-polyalkylsiloxane copolymers according to the above formulae (I) to (IV) are listed in the following table A:

TABLE A

| Compound | Formula | Ratio m/n | R' | Molecular Weight |
|---|---|---|---|---|
| Silwet ™ L-720 | IV | 1:1 | Butyl | 12,000 |
| Silwet ™ L-7001 | III | 2:3 | Methyl | 20,000 |
| Silwet ™ L-7002 | III | 1:1 | Butyl | 8,000 |
| Silwet ™ L-7200 | III | 3:1 | H | 19,000 |
| Silwet ™ L-7210 | III | 1:5 | H | 13,000 |
| Silwet ™ L-7230 | III | 2:3 | H | 29,000 |

Silwet is a registered trademark of Union Carbide Chemicals and Plastics Company. The polyalkylene oxide-polyalkylsiloxane copolymer can be present in the dispersing medium at a concentration ranging from 5 to 200 mg per mole of total silver added during precipitation.

The presence of the polyalkylene oxide-polyalkylsiloxane copolymer enables the growth of tabular silver halide grain emulsions having a further reduced amount of non-conforming grains and a still lower coefficient of variation (COV). The term "reduced amount of non-conforming grains" means that silver halide grains having a crystal shape different from the tabular shape, such as, for example, cubic shape, octahedral shape rod shape and the like, are present in a percentage lower than 5%, preferably lower than 3% based on the total number of the silver halide grains of the resulting emulsion. The term "lower coefficient of variation" means that the COV of the emulsion obtained in presence of a polyalkylene oxidepolyalkylsiloxane copolymer is lower than the COV of a corresponding emulsion prepared in absence of the polyalkylene oxide-polyalkylsiloxane copolymer. A COV reduction of 5 point percentage, preferably of 10 point percentage is obtained with the presence of polyalkylene oxide-polyalkylsiloxane copolymer.

CHEMICAL SENSITIZATION

Prior to use, the tabular silver halide grain emulsion prepared according to the method of the present invention is generally fully dispersed and bulked up with gelatin or other dispersion of peptizer and subjected to any of the known methods for achieving optimum sensitivity.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. The tabular silver halide grains for use in the present invention, after grain formation and desalting, are chemically sensitized by at least one gold sensitizer and at least one thiosulfonate sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. It is also useful to increase the gold sensitization by using a thiocyanate together with the gold sensitizer, as described, for example, in T. H. James, The Theory of the Photographic Process, 4th edition, page 155, published by MacMillan Co., 1977. Specific examples of gold sensitizers include chloroauric acid, potassium chloroaurate, auric trichloride, sodium aurithiosulfate, potassium aurithiocyanate, potassium iodoaurate, tetracyanoaudc acid, 2-aurosulfobenzothiazole methochloride and ammonium aurothiocyanate.

Thiosulfonate sensitization is performed by adding a thiosulfonate sensitizer to the tabular silver halide emulsion and stirring the emulsion at a high temperature of 40° C. or more for a predetermined period of time.

The amounts of the gold sensitizer and the thiosulfonate sensitizer for use in the present invention change in accordance with the various conditions, such as activity of the gold and thiosulfonate sensitizer, type and size of tabular silver halide grains, temperature, pH and time of chemical ripening. These amounts, however, are preferably from 1 to 20 mg of gold sensitizer per mol of silver, and from 1 to 100 mg of thiosulfonate sensitizer per mol of silver. The temperature of chemical ripening is preferably 45° C. or more, and more preferably 50° C. to 80° C. The pAg and pH may take arbitrary values.

During chemical sensitization, addition times and order of gold sensitizer and thiosulfonate sensitizer are not particularly limited. For example, gold and thiosulfonate sensitizers can be added at the initial stage of chemical sensitization or at a later stage either simultaneously or at different times. Usually, gold and thiosulfonate sensitizers are added to the tabular silver halide emulsion by their solutions in water, in a water-miscible organic solvent, such as methanol, ethanol and acetone, or as a mixture thereof.

SPECTRAL SENSITIZATION

The tabular silver halide emulsions of the present invention are preferably spectrally sensitized. It is specifically contemplated to employ in the present invention, in combination with the tabular silver halide emulsions, spectral sensitizing dyes having absorption maxima in the blue, minus blue (i.e., green and red) and infrared portions of the electromagnetic spectrum. Spectral sensitizing dyes for use in the present invention include polymethine dyes, such as cyanine and complex cyanine dyes, merocyanine and complex merocyanine dyes, as well as other dyes, such as oxonols, hemioxonols, styryls, merostyryls and streptocyanines as described by F. M. Hamer, The Cyanine and Related Compounds, Interscience Publishers, 1964.

The cyanine dyes include, joined by a methine linkage, two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

The merocyanine dyes include, joined by a methine linkage, a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

Of the above dyes, dyes most effectively used in the present invention are cyanine dyes, such as those represented by the following formula:

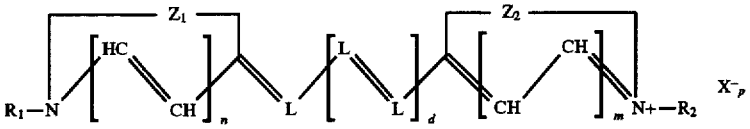

wherein n, m, p and d each independently represents 0 or 1, L represents a methine linkage, e.g., =CH—, ≡C($C_2H_5$), etc., $R_1$ and $R_2$ each represents a substituted or unsubstituted alkyl group, preferably a lower alkyl group of from 1 to 4 carbon atoms, e.g., methyl, ethyl, propyl, butyl, cyclohexyl and dodecyl, a hydroxyalkyl group, e.g., β-hydroxyethyl and Ω-hydroxybutyl, an alkoxyalkyl group, e.g., β-methoxyethyl and Ω-butoxyethyl, a carboxyalkyl group, e.g., β-carboxyethyl and Ω-carboxybutyl, a sulfoalkyl group, e.g., β-sulfoethyl and Ω-sulfobutyl, a sulfatoalkyl group, e.g., β-sulfatoethyl and Ω-sulfatobutyl, an acyloxyalkyl group, e.g., β-acetoxyethyl, γ-acetoxypropyl and Ω-butyryloxybutyl, an alkoxycarbonylalkyl group, e.g., β-methoxycarbonylethyl and Ω-ethoxycarbonylbutyl, benzyl, phenethyl, or an aryl group of up to 30 carbon atoms, e.g., phenyl, tolyl, xylyl, chlorophenyl and naphthyl, X represents an acid anion, e.g., chloride, bromide, iodide, thiocyanate, sulfate, perchlorate, p-toluenesulfonate and methylsulfate; said methine linkage forming an intramolecular salt when p is O; $Z_1$ and $Z_2$, the same or different, each represents the non metallic atoms necessary to complete the same simple or condensed 5- or 6-membered heterocyclic nucleus, such as a benzothiazole nucleus (e.g., benzothiazole, 3-, 5-, 6- or 7-chloro-benzothiazole, 4-, 5- or 6-methylbenzothiazole, 5- or 6-bromobenzothiazole, 4- or 5-phenyl-benzothiazole, 4-, 5- or 6-methoxybenzothiazole, 5,6-dimethyl-benzothiazole and 5- or 6-hydroxybenzothiazole), a naphthothiazole nucleus (e.g., α-naphthothiazole, β-naphthothiazole, 5-methoxy-β-naphthothiazole, 5-ethoxy-α-naphthothiazole and 8-methoxy-α-naphthothiazole), a benzoselenazole nucleus (e.g., benzoselenazole, 5-chloro-benzoselenazole and tetrahydrobenzoselenazole), a naphthoselenazole nucleus (e.g. α-naphtho-selenazole and β-naphthoselenazole), a benzoxazole nucleus (e.g., benzoxazole, 5- or 6-hydroxybenzoxazole, 5-chloro-benzoxazole, 5-or 6-methoxybenzoxazole, 5-phenyl-benzoxazole and 5,6-dimethylbenzoxazole), a naphthoxazole nucleus (e.g., α-naphthoxazole and β-naphthoxazole), a 2-quinoline nucleus (e.g., 2-quinoline, 6-, 7, or 8-methyl-2-quinoline, 4-, 6- or 8-chloro-2-quinoline, 5-, 6- or 7-ethoxy-2-quinoline and 6- or 7-hydroxy-2-quinoline), a 4-quinoline nucleus (e.g., 4quinoline, 7- or 8-methyl-4-quinoline and 6-methoxy-4-quinoline), a benzimidazole nucleus (e.g., benzimidazole, 5-chloro-benzimidazole and 5,6-dichlorobenzimidazole), a thiazole nucleus (e.g., 4- or 5-methylthiazole, 5-phenyl-thiazole and 4,5-di-methyl-thiazole), an oxazole nucleus (e.g., 4- or 5-methyl-oxazole, 4-phenyloxazole, 4-ethyl-oxazole and 4,5-dimethyl-oxazole), and a selenazole nucleus (e.g., 4-methyl-selenazole and 4-phenylselenazole. More preferred dyes within the above class are those having an internal salt group and/or derived from benzoxazole and benzimidazole nuclei as indicated before. Typical methine spectral sensitizing dyes for use in the present invention include those listed below.

Dye A

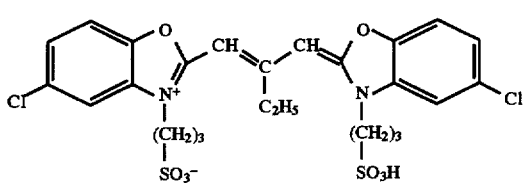

Dye B

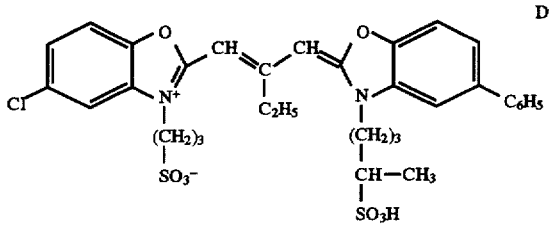

Dye C

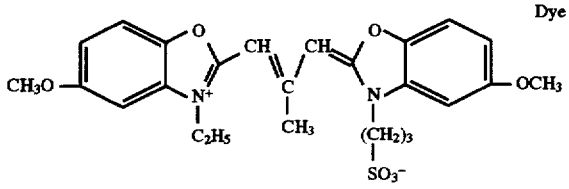

Dye D

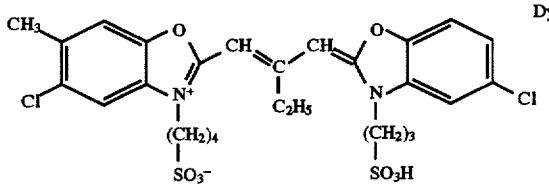

Dye E

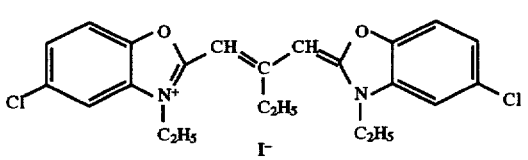

Dye F

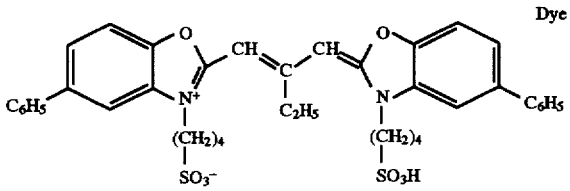

Dye G

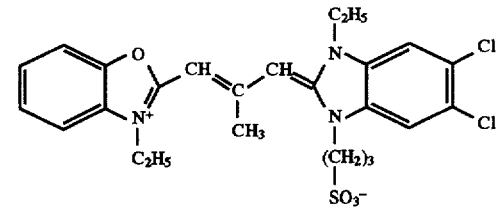

The methine spectral sensitizing dyes for use in this invention are generally known in the art. Particular reference can be made to U.S. Pat. Nos. 2,503,776, 2,912,329, 3,148, 187, 3,397,060, 3,573,916 and 3,822,136 and FR Pat. No. 1,118,778. Also their use in photographic emulsions is very known wherein they are used in optimum concentrations corresponding to desired values of sensitivity to fog ratios. Optimum or near optimum concentrations of spectral sensitizing yes in the emulsions of the present invention generally go from 10 to 500 mg per mol of silver, preferably from 50 to 200, more preferably from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants. development accelerators nod inhibitors, optical brighteners, surfactants and antistatic agents, as described by Gilman, Phonographic Science and Engineering, 18, pp. 418–430, 974 and in U.S. Pat. Nos. 2,933,390, 3,635,721, 3,748,510, 3,615,613, 3,615,614, 3,617,295 and 3,685,721.

Preferably, spectral sensitizing dyes are used in supersensitizing combination with polymeric compounds containing an aminoallylidenemalononitrile (>N—CH=CH—CH=$(CN)_2$) moiety, as those described in U.S. Pat. No. 4,807, 183. Said polymeric compounds are preferably obtained upon copolymerization of an allyl monomer which has an ethylenically condensed aminoallylidenemalononitrile moiety (such as dilallylaminoallylidenemalononitile monomer therein with ethylenically unsaturated monomer, said monomer being preferably a water-soluble monomer; said copolymerization being preferably a solution polymerization said polymeric compound being preferably a water-soluble polymer; said monomer more preferably being an acrylic or methacrylic monomer, most preferably being acrylamide or acrylic acid.

Examples of polymeric compounds which can be used in supersensitizing combination with spectral sensitizing dyes are preferably the polymeric compounds described in the following Table B wherein the monomer is copolymerized (in solution in the presence of a polymerization initiator) with a diallylaminoallylidenemalononitrile monomer, as well as a weight percent quantity of aminoallylidenemalononitrile moieties (AAMN) within the polymers themselves are indicated.

TABLE B

| Compound | Monomer | % AAMN |
|---|---|---|
| 1 | Acrylamide | 9 |
| 2 | Methacrylic acid | 11 |
| 3 | Acrylamide | 10.5 |
| 4 | Acrylic acid | 23 |
| 5 | Acrylamide | 44 |
| 6 | Vinylpirrolidone | 44 |
| 7 | Vinyloxazolidone | 14.5 |
| 8 | Vinyloxazolidone | 37 |
| 9 | Methacrylamide | 8 |
| 10 | Acrylamide-Allylamide.HCl | 10 |
| 11 | Acrylamide-Diallylamide.HCl | 7 |

Methods of preparation of said polymeric compounds are described in the above mentioned U.S. Pat. No. 4,307,183. The optimum concentrations of said polymeric compounds generally go from 10 to 1,000 mg per mol of silver, preferably from 50 to 500, more preferably from 150 to 350, the weight ratio of the polymeric compound to the spectral sensitizing dye normally being of 10/1 to 1/10, preferably 5/1 to 1/5, more preferably 2.5/1 to 1/1 (such a ratio of course depending upon the aminoallylidene-malononitrile moiety content of the polymeric compound: the higher such content, the lower such ratio).

Spectral sensitization can be performed at any stage of silver halide preparation. It can be performed subsequent to the completion of chemical sensitization or concurrently with chemical sensitization, or can precede chemical sensitization or even can commence prior to the completion of silver halide precipitation. In the preferred form, spectral sensitizing dyes can be incorporated in the tabular grain silver halide emulsions prior to chemical sensitization.

PHOTOGRAPHIC MATERIAL

The tabular silver halide grain emulsions are useful in light-sensitive photographic materials. A light-sensitive silver halide photographic material can be prepared by coating the above described silver halide emulsion on a photographic support. There is no limitation with respect to the support. Examples of materials suitable for the preparation of the support include glass, paper, polyethylene-coated paper, metals, cellulose nitrate, cellulose acetate, polystyrene, polyesters such as polyethylene terephthalate, polyethylene, polypropylene and other well-known supports.

Said light-sensitive silver halide photographic material specifically is application to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, etc.

Preferred light-sensitive silver halide photographic materials are X-ray light-sensitive materials comprising the above described silver halide emulsion coated on one surface, preferably on both surfaces of a support, preferably a polyethylene terephthalate support. Preferably, the silver halide emulsion is coated on the support at a total silver coverage comprised in the range of 3 to 6 grams per square meter. Usually, the X-ray light-sensitive materials are associated with intensifying screens so as to be exposed to radiation emitted by said screens. The screens are made of relatively thick phosphor layers which transform the X-rays into light radiation (e.g., visible light). The screens absorb a portion of X-rays much larger than the light-sensitive material and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

The exposed light-sensitive materials of this invention can be processed by any of the conventional processing techniques. The processing can be a black-and-white photographic processing for forming a silver image or a color photographic processing for forming a dye image depending upon the purpose. Such processing techniques are illustrated for example in Research Disclosure, 17643, December 1978. Roller transport processing in an automatic processor is particularly preferred, as illustrated in U.S. Pat. Nos. 3,025,779, 3,515,556, 3,545,971 and 3,647,459 and in U.S.

Pat. No. 1,269,268. Hardening development can be undertaken, as illustrated in U.S. Pat. No. 3,232,761.

The silver halide emulsion layer containing the tabular silver halide grain emulsion obtained with the method of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The present invention is now illustrated by reference to the following examples, which are not intended to limit the scope of the invention.

EXAMPLE

Emulsion 1

An aqueous gelatin solution consisting of 2160 ml of water, 12.5 g of deionized gelatin, 12.6 g of potassium bromide, and 7 ml of a 4N $HNO_3$ solution was put in a 10 liter reaction vessel. The pBr was about 1.3 and the pH about 2.0.

Nucleation: 35 ml of a 1.96N silver nitrate aqueous solution and 35 ml of a 1.96N potassium bromide solution were added by double jet addition over a period of 33 seconds at a constant flow rate, while keeping the temperature constant at 45° C. Ripening: The double jet addition of silver and bromide salts was stopped. The silver halide nuclei were ripened at 70° C. over 20 minutes under agitation. After 15 minutes from the start of ripening, a solution of ammonia was added to give a pH of about 10.5. At the end the vessel content was neutralized to pH 6.85 with a 4N $HNO_3$ solution.

First Growth: A 1.96N silver nitrate aqueous solution was added to raise the pBr to a value of about 1.6. After that, 405 ml of a 1.96N silver nitrate aqueous solution and the corresponding amount of a 1.96N potassium bromide aqueous solution were added to the vessel by accelerated double jet method, with a linear addition ramp rising from 7.5 ml/min to 20.8 ml/min by keeping the pBr constant at 1.6.

Second Growth: A 1.96N silver nitrate aqueous solution was added to raise the pBr to a value of about 2.4. After that, 439 ml of a 1.96N silver nitrate aqueous solution and the corresponding amount of a 1.96N potassium bromide aqueous solution were added to the vessel by accelerated double jet method, with a linear addition ramp rising from 7.5 ml/min to 26.5 ml/min by keeping the pBr constant at 2.4.

Final Growth: 645 ml of a 1.96N silver nitrate aqueous solution and the corresponding amount of a 1.96N potassium bromide aqueous solution were added to the vessel by accelerated double jet method, with a linear addition ramp rising from 27 ml/min to 37.5 ml/min by keeping the pBr constant at 2.4.

At the end of the tabular silver halide grain formation, water soluble salts were removed from the emulsion by procedures known in the art.

Emulsion 2

The procedure of emulsion 1 was repeated, except that Silwet™ L7001 was additionally present in the reaction vessel prior to the nucleation step and further added at the end of the ripening step. The total amount of Silwet™ L7001 was about 170 mg per mole of silver introduced into the emulsion. Silwet™ L7001 is the trade name of a surfactant satisfying the general formula (III) described above wherein R' is methyl and having a molecular weight of 20,000 Dalton, which is manufactured and sold by the Union Carbide Company.

Emulsion 3

The procedure of emulsion 1 was repeated, except that Silwet™ L7001 was additionally present in the reaction vessel prior to the nucleation step. The total amount of Silwet™ L7001 was about 32 mg per mole of silver introduced into the emulsion.

The resulting tabular grain emulsions 1 to 3 showed the characteristics exposed in the following Table 1.

TABLE 1

| | Emulsion 1 | Emulsion 2 | Emulsion 3 |
|---|---|---|---|
| Average Diameter | 1.39 μm | 0.81 μm | 1.02 μm |
| Average Thickness | 0.184 μm | 0.310 μm | 0.195 μm |
| Average Aspect Ratio | 7.55 | 2.61 | 5.23 |
| Projected Area | 98.5% | 99% | 98% |
| Tabular Grain Population | 95% | 98% | 96% |
| Standard Deviation | 0.26 | 0.089 | 0.12 |
| COV | 19% | 11% | 11.5% |

The data of Table 1 clearly show the benefit of the present invention. The population of non-conforming grains (other than tabular grains) has been highly reduced with the process of the present invention and accounts to not more than 5% of the total grain population. The coefficient of variation of the tabular silver halide emulsion is further reduced by the addition of the polyalkylene oxidepolyalkylsiloxane copolymer.

I claim:

1. A process of preparing monodispersed tabular silver halide grain emulsions, said process comprising the following steps:

(a) forming a population of silver halide nuclei in a dispersing medium having a pH lower than 3 and a pBr in the range of from 1 to 2, (b) ripening said population of silver halide nuclei in presence of a silver halide solvent, (c) performing a first growing of said silver halide nuclei at a pBr value in the range of from 1 to 2, and (d) performing a second growing of said silver halide nuclei at a pBr value in the range of from 2 to 2.7.

2. The process according to claim 1, wherein said monodispersed tabular silver halide emulsion comprises tabular silver halide grains having a thickness lower than 0.4 μm and an average aspect ratio higher than 3:1, the projected area of said tabular silver halide grains accounting for at least 80% of the total projected area.

3. The process according to claim 1, wherein said monodispersed tabular silver halide emulsion has a coefficient of variation lower than 20%.

4. The process according to claim 1, wherein the pH value of said dispersing medium during step (a) ranges from 1.5 to 2.5.

5. The process according to claim 1, wherein the pBr value of said dispersing medium during step (a) ranges from 1.2 to 1.7.

6. The process according to claim 1, wherein said silver halide solvent is added during said ripening step (b).

7. The process according to claim 1, wherein said silver halide solvent is added after at least 5 minutes from the start of the ripening step.

8. The process according to claim 1, wherein said silver halide solvent is ammonia.

9. The process according to claim 1, wherein said first growing step (c) is performed at a pBr value in the range of from 1.2 to 1.8.

10. The process according to claim 1, wherein said second growing step (d) is performed at a pBr value in the range of from 2.2 to 2.6.

11. The process according to claim 1, wherein a polyalkylene oxidepolyalkylsiloxane copolymer is added during at least one of said steps (a), (b), (c), and (d).

12. The process according to claim 1, wherein a polyalkylene oxidepolyalkylsiloxane copolymer is added during said nucleation step (a).

13. The process according to claim 11, wherein said polyalkylene oxidepolyalkylsiloxane copolymer has the following general formula (I):

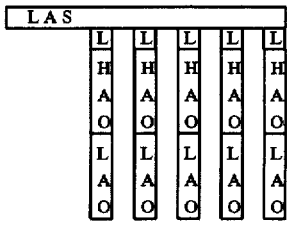

(I)

wherein LAS represents a lipophilic alkylene siloxane block unit, HAO represents a hydrophilic alkylene oxide block unit, LAO represents a terminal lipophilic alkylene oxide block unit, and L is a lipophilic hydrocarbon system.

14. The process according to claim 11, wherein said polyalkylene oxidepolyalkylsiloxane copolymer has the following general formula (II):

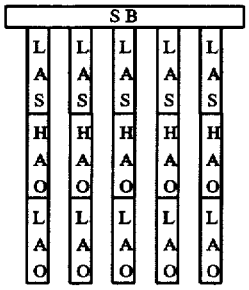

(II)

wherein LAS represents a lipophilic alkylene siloxane block unit, HAO represents a hydrophilic alkylene oxide block unit, LAO represents a terminal lipophilic alkylene oxide block unit, and SB is a silicone backbone.

15. The process according to claim 11, wherein said polyalkylene oxidepolyalkylsiloxane copolymer has the following general formula (III):

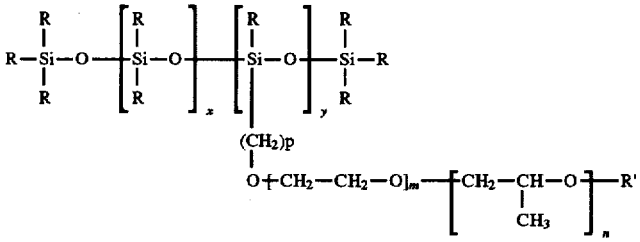

(III)

wherein R is a methyl group, R' can be either hydrogen or a lower alkyl radical of from 1 to 4 carbon atoms, x is an integer from 0 to 100, y is an integer from 1 to 50, m is an integer from 1 to 50, n is an integer from 1 to 50, and p is an integer from 2 to 6.

16. The process according to claim 11, wherein said polyalkylene oxidepolyalkylsiloxane copolymer has the following general formula (IV):

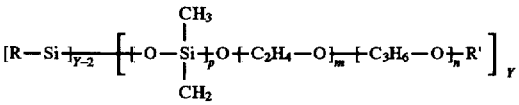

(IV)

wherein R is a methyl group, R' can be either hydrogen or a lower alkyl radical of from 1 to 4 carbon atoms, y is an integer from 3 to 50, m is a integer from 1 to 50, n is an integer from 1 to 50, and p is an integer from 1 to 50.

17. The process according to claim 11, wherein said polyalkylene oxidepolyalkylsiloxane copolymer is present in the dispersing medium at a concentration ranging from 5 to 200 mg per mole of total silver added during silver halide grain formation.

* * * * *